US005822953A

United States Patent [19]

Kagawa et al.

[11] Patent Number: 5,822,953

[45] Date of Patent: Oct. 20, 1998

[54] METHOD OF AND SYSTEM FOR PACKAGING ROLLS OF PHOTOGRAPHIC FILM IN BOX

[75] Inventors: Sakae Kagawa; Kazunori Nagano, both of Minamiashigara, Japan

[73] Assignee: Fuji Photo Film Co., Ltd., Kanagawa, Japan

[21] Appl. No.: 759,718

[22] Filed: Dec. 6, 1996

[30] Foreign Application Priority Data

Dec. 7, 1995 [JP] Japan ..... 7-319173
Dec. 7, 1995 [JP] Japan ..... 7-319178

[51] Int. Cl.[6] ..... B65B 35/30

[52] U.S. Cl. ..... 53/544; 53/542; 53/534; 414/758

[58] Field of Search ..... 53/542, 534, 544, 53/531, 118, 252; 198/418, 347; 914/761, 765, 767, 758, 770, 783

[56] References Cited

U.S. PATENT DOCUMENTS

| | | | |
|---|---|---|---|
| 3,609,938 | 10/1971 | Paddock | 53/544 |
| 4,672,795 | 6/1987 | Alexander et al. | 53/544 |
| 4,776,148 | 10/1988 | Mingozzi | 53/544 |
| 4,864,801 | 9/1989 | Fallas | 53/544 |
| 5,395,207 | 3/1995 | Hoffman | 53/544 |
| 5,439,093 | 8/1995 | Drewitz | 198/397 |
| 5,501,064 | 3/1996 | Ingram et al. | 53/252 |
| 5,555,706 | 9/1996 | Maoloni et al. | 53/544 |

*Primary Examiner*—James F. Coan
*Assistant Examiner*—Gene L. Kim
*Attorney, Agent, or Firm*—Sughrue, Mion, Zinn, Macpeak & Seas, PLLC

[57] ABSTRACT

A film packaging system has a tubular casing arraying and conveying device for arraying and conveying tubular casings each housing a roll of unexposed photographic film, a packing device for inserting the tubular casings into respective first packaging cartons each having a packaging carton housing and a tongue-like hanger integral with the packaging carton housing, a packaging carton conveying device for successively conveying the first packaging cartons, and a charging device for picking up a desired number of first packaging cartons conveyed by the packaging carton conveying device, arraying the desired number of picked-up first packaging cartons and a desired number of second packaging cartons, each having a packaging carton housing and a tongue-like hanger integral with the packaging carton housing, such that the hangers are oriented in opposite directions, and placing the array of first and second packaging cartons into a box.

16 Claims, 13 Drawing Sheets

METHOD OF AND SYSTEM FOR PACKAGING ROLLS OF PHOTOGRAPHIC FILM IN BOX

BACKGROUND OF THE INVENTION

1. Field of the Invention

The present invention relates to a method of and a system for packaging rolls of photographic film housed in respective tubular casings by inserting the rolls into respective packaging cartons with hangers and placing a desired number of such packaging cartons with hangers and a desired number of other packaging cartons with hangers into a box.

2. Description of the Related Art

Packages of unexposed photographic film are usually produced by housing rolls of unexposed photographic film into respective tubular casings of synthetic resin, and then placing the tubular casings into respective packaging cartons of paper. The packaging cartons may be cube-shaped packaging cartons or packaging cartons with integral tonguelike hangers for hanging the packaging cartons.

A plurality of packaging cartons, e.g., four through six packaging cartons, each housing a roll of unexposed photographic film are placed into a box. A plurality that makes such boxes are then housed in a case for shipment. In a factory of rolls of photographic film, therefore, it has been customary to carry out a film packaging process by inserting tubular casings housing respective rolls of photographic film into respective packaging cartons, placing a predetermined number of packaging cartons into a box, and then housing a plurality of such boxes in a case.

When packaging cartons with tongue-like hangers are used, the tongue-like hangers pose a problem because they prevent the packaging cartons from being handled with ease, making it difficult to automate the film packaging process. For example, different types of packaging cartons with tongue-like hangers are inserted into a box as follows: The packaging cartons are arrayed such that a packaging carton of one type is positioned in overlapping relation to the tongue-like hanger of a packaging carton of another type, and thereafter the arrayed packaging cartons are inserted into a box. These steps of the film packaging process are manually performed by the worker. Therefore, the film packaging process is relatively tedious and time-consuming to carry out. The film packaging process becomes inefficient and inaccurate particularly if the numbers of packaging cartons of different kinds with tongue-like hangers, which are to be combined and inserted into a box, are changed.

SUMMARY OF THE INVENTION

It is a general object of the present invention to provide a method of and a system for packaging rolls of photographic film, housed in respective packaging cartons with hangers, automatically and efficiently in a box.

A major object of the present invention is to provide a method of and a system for packaging rolls of photographic film, housed in packaging cartons of different types with hangers, by automatically arraying desired numbers of those packaging cartons of different types and placing the packaging cartons into a box.

The above and other objects, features, and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
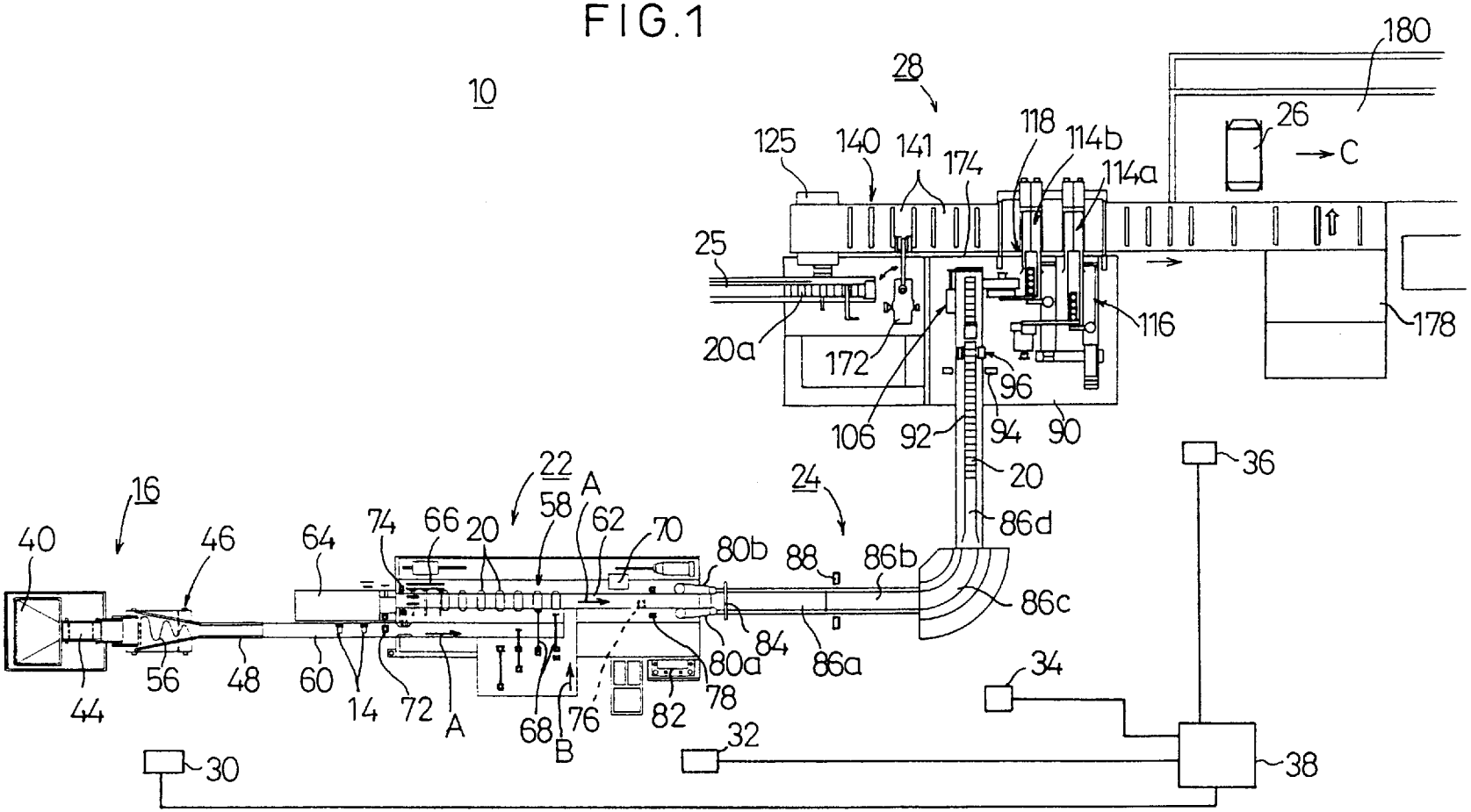
FIG. 1 is a schematic plan view of a system for packaging rolls of photographic film in a box according to the present invention.
Figure 2:
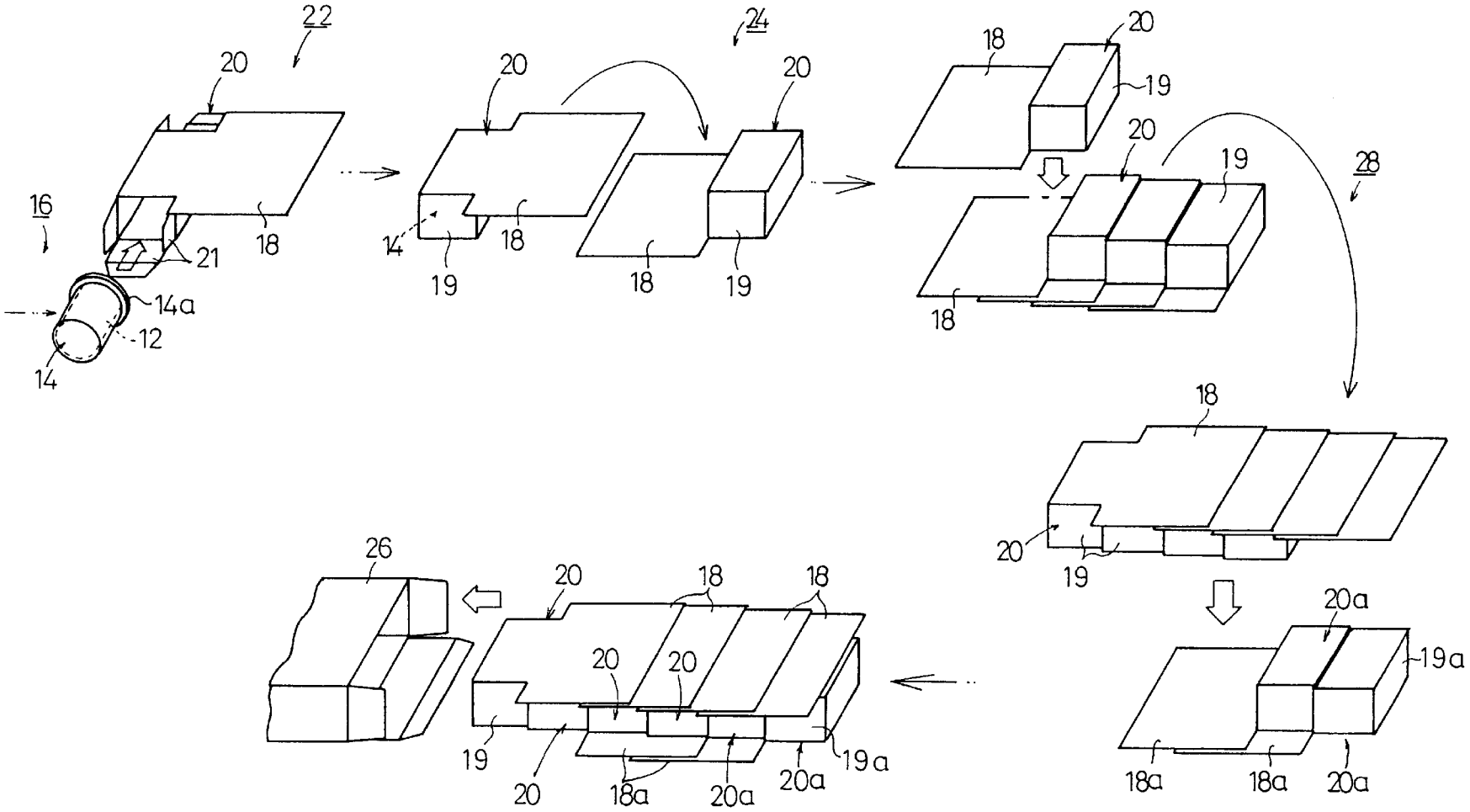
FIG. 2 is a schematic fragmentary perspective view illustrating a method of packaging rolls of photographic film in a box according to the present invention.

FIG. 1 schematically shows a film packaging system 10 for packaging rolls of photographic film in a box according to the present invention, and FIG. 2 schematically illustrates a method of packaging rolls of photographic film in a box according to the present invention, which method is carried out by the film packaging system 10.

As shown in FIGS. 1 and 2, the film packaging system 10 generally comprises a tubular casing arraying and conveying device 16 for arraying and conveying tubular casings 14 each housing a roll 12 of unexposed photographic film, a packing device 22 for inserting the tubular casings 14 into respective first packaging cartons 20 each having a packaging carton housing 19 and a tongue-like hanger 18 integral with the packaging carton housing 19, a packaging carton conveying device 24 for turning the first packaging cartons 20 into a predetermined attitude and successively conveying the first packaging cartons 20, and a charging device 28 for picking up a desired number of first packaging cartons 20 conveyed by the packaging carton conveying device 24, arraying the desired number of picked-up first packaging cartons 20 and a desired number of second packaging cartons 20*a*, each having a packaging carton housing 19*a* and a tongue-like hanger 18*a* integral with the packaging carton housing 19*a*, introduced from a packaging carton conveying mechanism 25, such that the hangers 18, 18*a* are oriented in opposite directions, and placing the array of first and second packaging cartons 20, 20*a* into a box 26.

As shown in FIG. 1, the tubular casing arraying and conveying device 16, the packing device 22, the packaging carton conveying device 24, and the charging device 28 are individually controlled by respective first, second, third, and fourth controllers 30, 32, 34, 36 which are controlled by a main controller 38.

Figure 3:
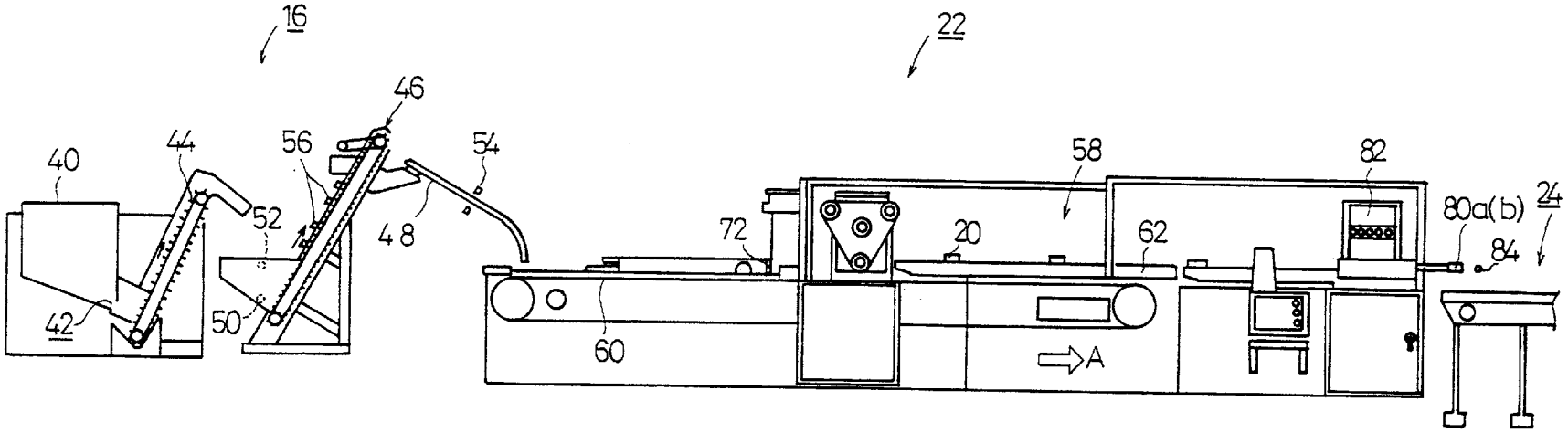
FIG. 3 is a side elevational view of a tubular casing arraying and conveying device and a packing device of the packaging system.

As shown in FIGS. 1 and 3, the tubular casing arraying and conveying device 16 comprises a hopper 40 for introducing a number of tubular casings 14 each housing a roll 12 of unexposed photographic film, a first lift conveyor 44 for delivering the tubular casings 14 from an outlet 42 of the hopper 40, a second lift conveyor 46 for upwardly delivering the tubular casings 14 supplied from the first lift conveyor 44 while arranging the tubular casings 14 into an array, and a chute 48 for downwardly delivering the arrayed tubular casings 14 discharged from the second lift conveyor 46, in a desired attitude to the packing device 22.

As shown in FIG. 3, the second lift conveyor 46 has first and second photosensors 50, 52 for detecting the remaining number of tubular casings 14 supplied to the second lift conveyor 46, and the chute 48 has a third photosensor 54 for detecting each of tubular casings 14 as it passes through the chute 48. The second lift conveyor 46 has a screw (not shown) disposed along a tubular casing passage thereof for lifting the supplied tubular casings 14, and has its width progressively smaller in the upward direction. A rubber member 56 is mounted in the tubular casing passage for preventing the tubular casings 14 from being superimposed and hence damaged.

The packing device 22 has a conveyor 60 for delivering the tubular casings 14 successively supplied in an array from the chute 48 to a packing station 58, and a packaging carton conveyor 62 disposed parallel to the conveyor 60 and positioned downstream the conveyor 60. As shown in FIG. 1, the packing device 22 also has a cartoon supply unit 64 disposed upstream of the packaging carton conveyor 62 for supplying first packaging carton blanks before they are formed into first packaging cartons 20, and a packaging carton forming mechanism 66 disposed adjacent to the cartoon supply unit 64. The packaging carton forming mechanism 66 has a suction pad (not shown) for attracting a first packaging carton blank to form a first packaging carton 20 therefrom.

As shown in FIG. 1, the packing station 58 has a plurality of parallel pusher rods 68 extending transversely with respect to the conveyor 60. The pusher rods 68 are movable back and forth in the direction indicated by the arrow B for inserting tubular casings 14 positioned on the conveyor 60 and delivered in the direction indicated by the arrow A, which is perpendicular to the direction indicated by the arrow B, into respective first packaging cartons 20 positioned on the packaging carton conveyor 62 and delivered in the direction indicated by the arrow A.

The packing device 22 also has a hot-melt mechanism 70 disposed downstream of the packing station 58 for bonding flaps 21 (see FIG. 2) of a first packaging carton 20 after a tubular casing 14 has been inserted therein.

The conveyor 60 has a fourth photosensor 72 for detecting whether a tubular casing 14 has a cap 14*a* or not. The packaging carton conveyor 62 has a fifth photosensor 74 for detecting whether a first packaging carton 20 has been placed in a predetermined position on the packaging carton conveyor 62, an electrostatic capacitance sensor 76 for detecting whether a tubular casing 14 is placed in a first packaging carton 20 after its flaps 21 has been bonded, and a sixth photosensor 78 for detecting a displacement of flaps 21 of a first packaging carton 20.

The packing device 22 further includes a pair of laterally spaced belts 80*a*, 80*b* positioned downstream of the packaging carton conveyor 62 for gripping opposite sides of a first packaging carton 20 and sending the first packaging carton 20 to the packaging carton conveying device 24, and a laser beam printer 82 for printing a first packaging carton 20 which is being gripped by the belts 80*a*, 80*b* and delivered to the packaging carton conveying device 24.

The packaging carton conveying device 24, which is positioned downstream of the belts 80*a*, 80*b*, has a rod 84 positioned immediately downstream of the belts 80*a*, 80*b*. The rod 84 serves as an attitude changing means for changing the attitude of a first packaging carton 20 as it is discharged from the belts 80*a*, 80*b*.

As shown in FIG. 1, the packaging carton conveying device 24 a plurality of successive conveyors 86*a*, 86*b*, 86*c*, 86*d* which operate at different speeds for adjusting the distances between first packaging cartons 20. The conveyor 86*a* has a weight checker (not shown) for detecting the weight of first packaging cartons 20 while they are being conveyed or stopped and rejecting first packaging cartons 20 which have a weight other than a normal weight. The conveyor 86*b*, which is positioned immediately downstream of and extends contiguously in alignment with the conveyor 86*a*, has a seventh photosensor 88 for detecting whether a first packaging carton 20 is present on the conveyor 86*b* or not. The conveyor 86*c* is arc-shaped and is positioned immediately downstream of and extends contiguously from the conveyor 86*b*. The conveyor 86*d* is positioned immediately downstream of and extends contiguously from the conveyor 86*c*.

Figure 4:
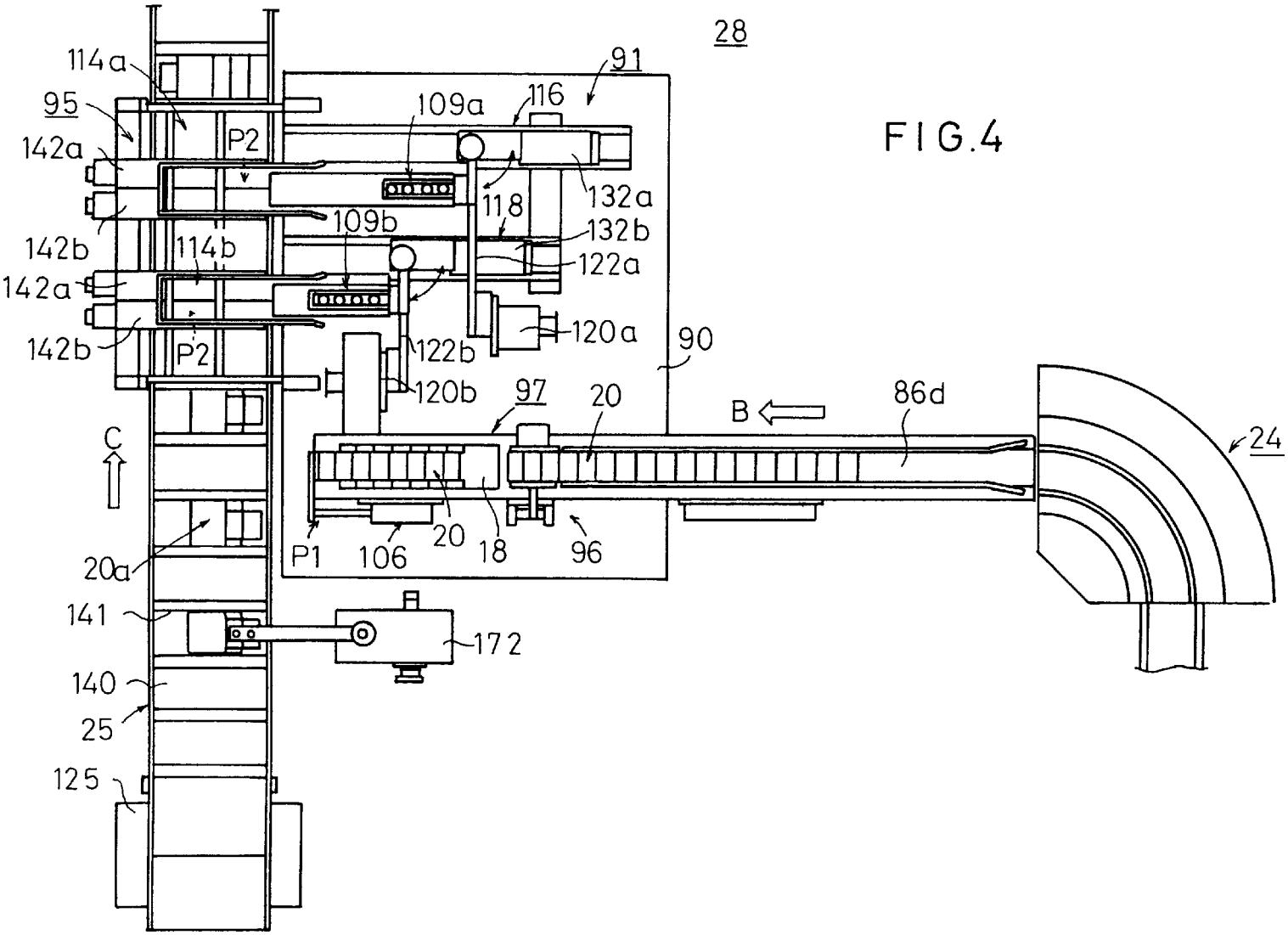
FIG. 4 is a plan view of a charging device of the packaging system.
Figure 5:
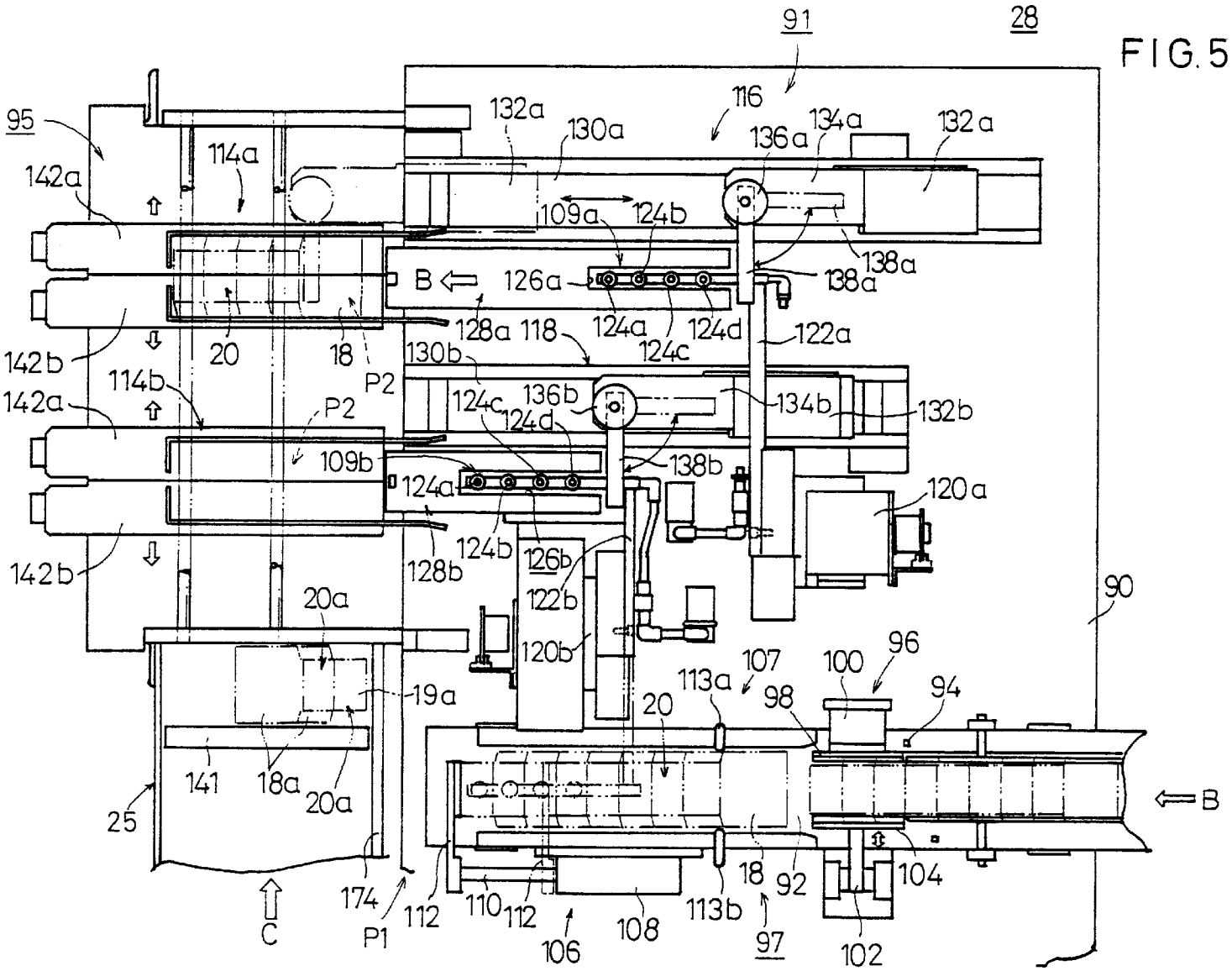
FIG. 5 is an enlarged fragmentary plan view of the charging device.

As shown in FIGS. 4 and 5, the charging device 28 has a packaging carton pickup mechanism 91 disposed in a packaging carton pickup position P1 for picking up a desired number of first packaging cartons 20 from the conveyor 86*d*, a packaging carton conveying mechanism 25 for placing a desired number of second packaging cartons 20*a* with their hangers 18*a* positioned downwardly, and delivering the second packaging cartons 20*a* to arraying positions P2, and a packaging carton placing mechanism 95 for placing the picked-up first packaging cartons 20 with their hangers 18 positioned upwardly and closely to the packaging carton housings 19*a* of the second packaging cartons 20*a*. The packaging carton placing mechanism 95 can be opened and closed above the packaging carton conveying mechanism 25 in the arraying positions P2.

The charging device 28 has a base 90 which supports the packaging carton pickup mechanism 91 thereon. A conveyor 92 contiguous to an end of the conveyor 86*d* and serving as a distribution mechanism 97 is mounted on the base 90. The conveyor 92 has an eighth photosensor 94 (see FIG. 5) for detecting whether a first packaging carton 20 is present on the conveyor 92 or not, and a packaging carton checking means 96 for engaging a first packaging carton 20 delivered to the conveyor 92. The packaging carton checking means 96 has a fixed pad 98 for engaging one side of a first packaging carton 20 and a movable pad 104 fixed to a swingable link 102 coupled to a cylinder 100, for engaging an opposite side of the first packaging carton 20.

As shown in FIG. 5, the charging device 28 has a packaging carton end limiting means 106 for limiting a tip end of a first packaging carton 20, and a hanger holding means 107 for holding the hanger 18 of a first packaging carton 20. The packaging carton end limiting means 106 has a cylinder 108 with a rod 110 extending therefrom in the direction indicated by the arrow B. A stopper 112 extending transversely over the conveyor 92 is fixed at an end thereof to a distal end of the rod 110. The hanger holding means 107 has a pair of air nozzles 113*a*, 113*b* positioned respectively on opposite sides of the conveyor 92 for ejecting air to opposite ends of the hanger 18 of a first packaging carton 20.

Figure 6:
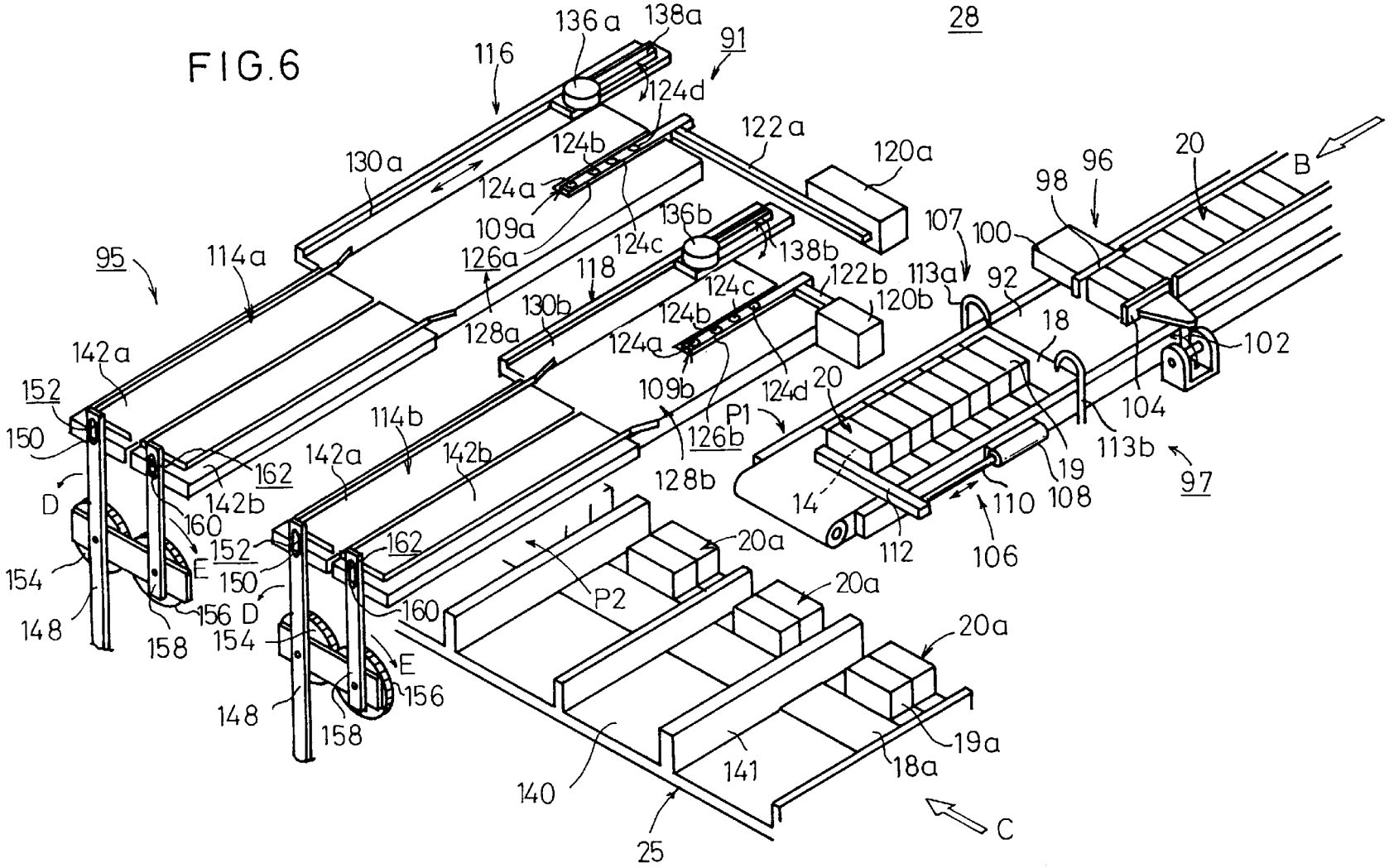
FIG. 6 is a perspective view of the charging device.
Figure 7:
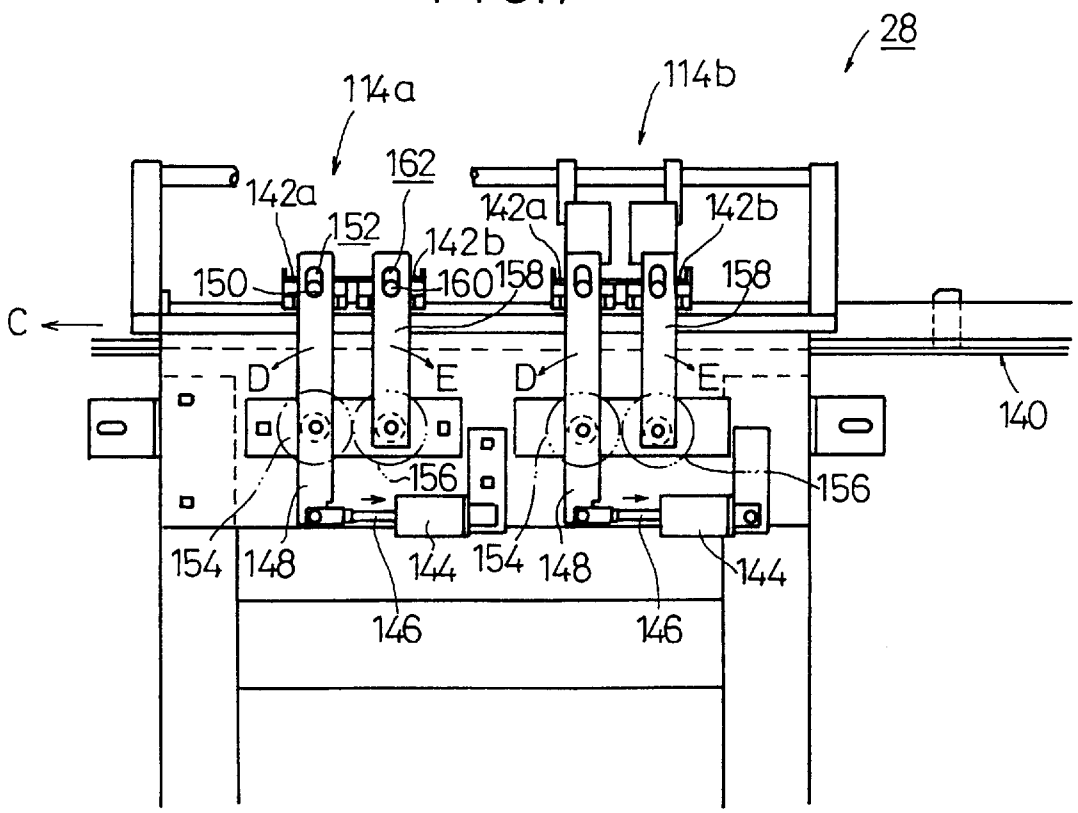
FIG. 7 is a fragmentary side elevational view of the charging device.
Figure 8:
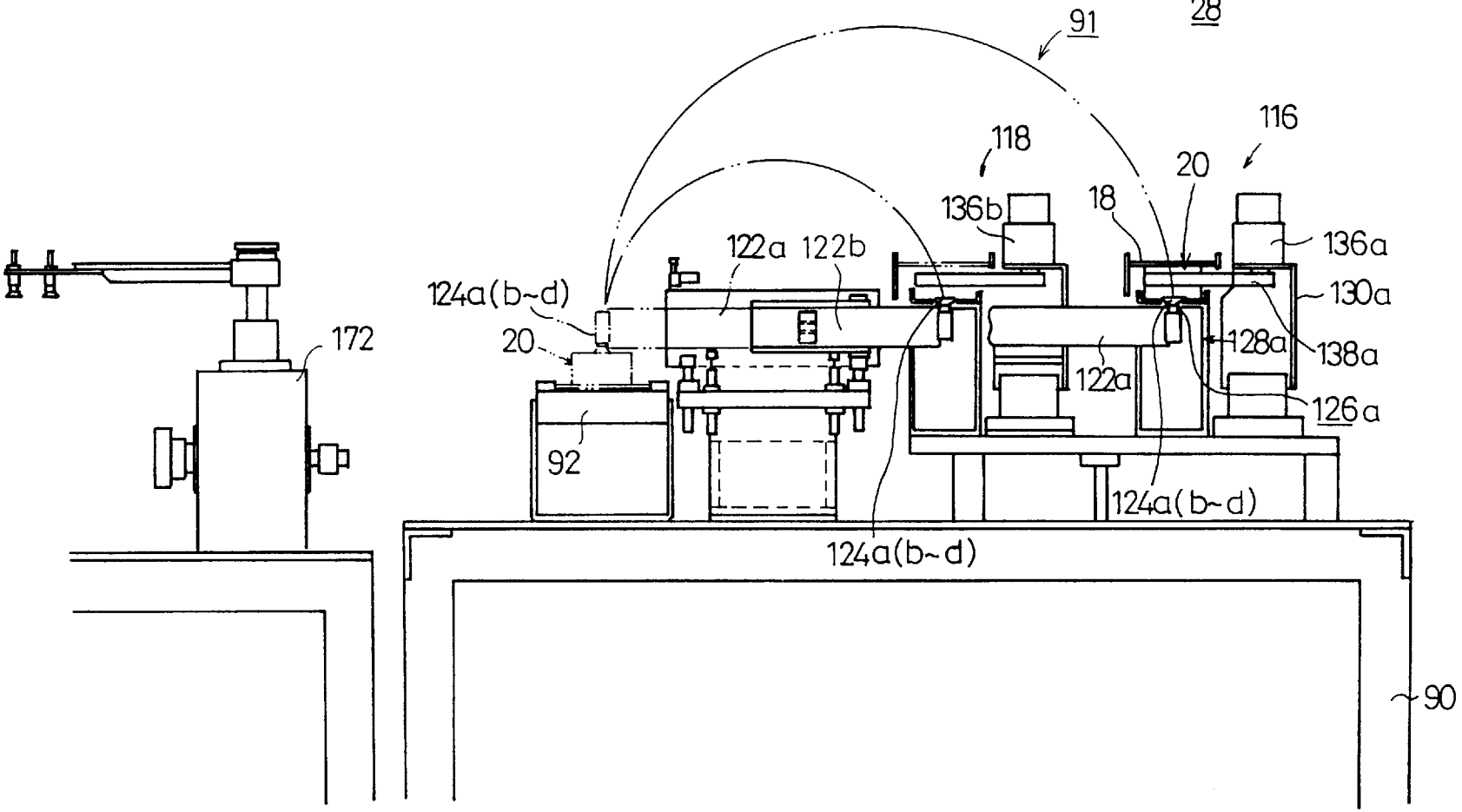
FIG. 8 is a side elevational view illustrative of the manner in which the charging device operates.

As shown in FIGS. 6 through 8, the packaging carton pickup mechanism 91 comprises first and second suction means 109*a*, 109*b* alternately operable, each for attracting and picking up four first packaging cartons 20 from a predetermined number of first packaging cartons 20 held by the packaging carton end limiting means 106, first and second rotary actuators (inverting means) 120*a*, 120*b* for inverting the first and second suction means 109*a*, 109*b*, respectively, which have attracted the first packaging cartons 20, and first and second packaging carton pickup means 116, 118 for delivering the inverted first packaging cartons 20 to the packaging carton placing mechanism 95.

A longer first rotary arm 122*a* is coupled to the first rotary actuator 120*a*, and a shorter second rotary arm 122*b* is coupled to the second rotary actuator 120*b*. The first and second suction means 109*a*, 109*b* comprise respective sets of first through fourth suction pads 124*a*, 124*b*, 124*c*, 124*d* arrayed in the direction indicated by the arrow B and attached to respective distal ends of the first and second rotary arms 122*a*, 122*b*. The first through fourth suction pads 124*a*~124*d* are connected to a vacuum pump 125 (see FIGS. 1 and 4). The first through fourth suction pads 124*a*, 124*b* are spaced at intervals corresponding to the respective positions of the first packaging cartons 20 on the conveyor 92.

In a position on the conveyor 92, the first through fourth suction pads 124*a*~124*d* have their suction faces oriented downwardly in confronting relation to the packaging carton housings 19 of the first packaging cartons 20 on the conveyor 92. In a position angularly spaced about 180° from the position on the conveyor 92, the first through fourth suction pads 124*a*~124*d* have their suction faces oriented upwardly. The first and second packaging carton pickup means 116, 118 are located in this position where the suction faces of the first through fourth suction pads 124*a*~124*d* are oriented upwardly.

The first and second packaging carton pickup means 116, 118 have respective first and second guide plates 128*a*, 128*b* extending parallel to each other in the direction indicated by the arrow B and having respective first and second parallel grooves 126*a*, 126*b* defined therein for allowing the respective sets of first through fourth suction pads 124*a*~124*d* to pass therethrough. The first and second packaging carton pickup means 116, 118 also have respective first and second travel paths 130*a*, 130*b* extending parallel and disposed adjacent to the first and second guide plates 128*a*, 128*b*, respectively. As shown in FIG. 5, the first and second travel paths 130*a*, 130*b* support thereon first and second rodless cylinders 132*a*, 132*b*, respectively, for back-and-forth movement in the direction indicated by the arrow B.

First and second rotary actuators 136*a*, 136*b* are mounted respectively on the first and second rodless cylinders 132*a*, 132*b* by respective first and second attachments 134*a*, 134*b*. The first and second rotary actuators 136*a*, 136*b* have respective first and second pusher rods 138*a*, 138*b* (see FIGS. 5 and 6) which are angularly movable through an angle of about 90° as indicated by the arrows.

The packaging carton placing mechanism 95 has first and second arraying stations (placing areas) 114*a*, 114*b* which are positioned forward of the respective first and second guide plates 128*a*, 128*b* in the direction indicated by the arrow B. The first arraying station 114*a* comprises a pair of support plates 142*a*, 142*b* movable toward and away from each other. As shown in FIG. 7, a cylinder 144 has a horizontal rod 146 coupled to a lower end of a longer link 148 which has an oblong hole 152 defined in an upper end thereof which receives a pin 150 projecting from a distal end of the support plate 142*a*. A first gear 154 is fixed to the longer link 148 at a pivoted position thereof and held in mesh with a second gear 156 fixed to a pivoted lower end of a shorter link 158. The shorter link 158 has an oblong hole 162 defined in an upper end thereof which receives a pin 160 projecting from a distal end of the support plate 142*b*.

The second arraying station 114*b* is identical to the first arraying station 114*a*. Those parts of the second arraying station 114*b* which are identical to those of the first arraying station 114*a* are denoted by identical reference characters, and will not be described in detail below.

As shown in FIGS. 4 through 6, the packaging carton conveying mechanism 25 has a packaging carton conveyor 140 movable in the direction indicated by the arrow C which is perpendicular to the direction indicated by the arrow B. The packaging carton conveyor 140 has a plurality of buckets 141 spaced at intervals for hosing second packaging cartons 20*a*. A robot 172 is positioned at an end of the carton conveyor 140 for picking up a predetermined number of second packaging cartons 20*a*, e.g., 1~3 second packaging cartons 20*a*, and delivering them into the respective buckets 141 of the packaging carton conveyor 140. In each of the buckets 141, the hangers 18*a* of the second packaging cartons 20*a* are positioned downwardly and downstream of the packaging carton housing 19*a* in the direction indicated by the arrow B. A presser means (not shown) is disposed on the packaging carton conveyor 140 for pressing the second packaging cartons 20*a* against an engaging plate 174 disposed at an upstream end of the packaging carton conveyor 140 in the direction indicated by the arrow B.

As shown in FIG. 1, a packaging carton inserting station 178 is positioned downstream of the packaging carton conveyor 140 in the direction indicated by the arrow C. The packaging carton inserting station 178 has a box feed path 180 extending parallel to the packaging carton conveyor 140 for conveying a formed box 26 in the direction indicated by the arrow C. In the packaging carton inserting station 178, desired numbers of first and second packaging cartons 20, 20*a* are inserted into the box 26. Although not shown, a hot-melt mechanism for bonding flaps of the box 26 and a printer for printing the box 26 are disposed on the packaging carton conveyor 140.

Operation of the film packaging system 10 for carrying out a method of packaging rolls of photographic film in a box according to the present invention will be described below.

First, the packaging method according to the present invention will briefly be described below with reference to FIG. 2. A plurality of tubular casings 14 each housing a roll 12 of unexposed photographic film therein are arrayed and delivered by the tubular casing arraying and conveying device 16 with the caps 14*a* facing in one direction. In the packing device 22, the tubular casings 14 are inserted into respective first packaging cartons 20 that are delivered parallel to the array of tubular casings 14. Then, the flaps 21 of each of the first packaging cartons 20 are bonded to the packaging carton housing 19, and the reverse side of the hanger 18 of the first packaging carton 20 is printed. Thereafter, the first packaging carton 20 is inserted by the packaging carton conveying device 24 to position the hanger 18 downwardly and upstream in the direction in which the first packaging carton 20 is delivered.

In the charging device 28, a predetermined number of first packaging cartons 20, e.g., four first packaging cartons 20, are picked up, and a desired number of second packaging cartons 20*a*, e.g., two second packaging cartons 20*a*, are combined and arrayed with each other with the respective hangers 18, 18*a* oriented in opposite directions. The six first and second packaging cartons 20, 20*a* thus arrayed are then inserted altogether into the box 26.

The packaging method according to the present invention will now be described in greater detail with respect to the film packaging system 10. The film packaging system 10 is automatically operated continuously under the control of the first, second, third, and fourth controllers 30, 32, 34, 36 which are controlled by the main controller 38.

As shown in FIGS. 1 and 3, tubular casings 14 stored in the hopper 40 are delivered from the outlet 42 thereof onto the first lift conveyor 44, which supplies the tubular casings 14 onto the second lift conveyor 46. On the second lift conveyor 46, the remaining number of tubular casings 14 is detected by the first and second photosensors 50, 52 when light transmitted therebetween is interrupted by the tubular casings 14. If light is continuously transmitted between first and second photosensors 50, 52 for a predetermined period of time, then the first lift conveyor 44 is operated to supply tubular casings 14 onto the second lift conveyor 46.

As tubular casings 14 are lifted upwardly by the second lift conveyor 46, since the width of the second lift conveyor 46 is progressively smaller in the upward direction, the tubular casings 14 are forcibly arrayed into a row when they reach the upper end of the second lift conveyor 46. The rubber member 56 mounted in the tubular casing passage of the second lift conveyor 46 serves to prevent the tubular casings 14 from being superimposed and hence damaged as they are being elevated along the tubular casing passage.

The tubular casings 14 are then supplied from the upper end of the second lift conveyor 46 onto the chute 48, along which the tubular casings 14 are delivered in an array onto the conveyor 60 of the packing device 22. The tubular casings 14 are conveyed along the conveyor 60 in the direction indicated by the arrow A, during which time the fourth photosensor 72 detects whether each of the tubular casings 14 has a cap 14*a* or not.

If a tubular casing 14 is detected as being devoid of a cap 14*a*, then it is sent to a stock unit (not shown) and a first packaging carton blank for forming a first packaging carton 20 for housing the tubular casing 14 is not supplied from the cartoon supply unit 64. Conversely, if a tubular casing 14 is detected as having a cap 14*a*, then the cartoon supply unit 64 supplies a first packaging carton blank to the packaging carton conveyor 62. The supplied first packaging carton blank is formed into a first packaging carton 20 by the packaging carton forming mechanism 66, and the formed first packaging carton 20 is delivered to the packing station 58. In this manner, a plurality of first packaging cartons 20 are delivered to the packing station 58. In the packing station 58, the pusher rods 68 are moved back and forth in the direction indicated by the arrow B thereby to insert corresponding tubular casings 14 the conveyor 60 into respective first packaging cartons 20.

The first packaging cartons 20 with the respective tubular casings 14 inserted therein are delivered in the direction indicated by the arrow A, with the hangers 18 positioned upwardly and directed downstream. Then, the flaps 12 of the first packaging cartons 20 are bonded by the hot-melt mechanism 70. Thereafter, the electrostatic capacitance sensor 76 detects whether a tubular casing 14 is placed in each of the first packaging cartons 20 based on the detection of a metal member on the tubular casing 14. The sixth photosensor 78 detects a displacement of the flaps 21 of each of the first packaging cartons 20. If such a displacement of the flaps 21 exceeds 1.5 mm, for example, the inspected first packaging carton 20 is judged as being defective and then rejected.

Those first packaging cartons 20 which are judged as being normal are delivered from the packaging carton conveyor 62 to the belts 80*a*, 80*b*, which grip opposite sides of the first packaging cartons 20 and feed them in the direction indicated by the arrow A. During this time, the first packaging cartons 20 are printed by the laser beam printer 82.

Figure 9A:
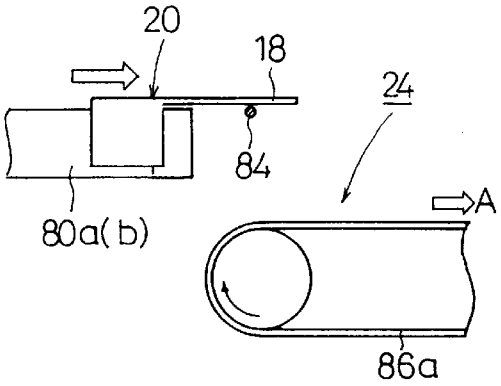
FIG. 9A is a fragmentary side elevational view showing a packaging carton immediately before it is delivered from the packaging device to a packaging carton conveying device.
Figure 9B:
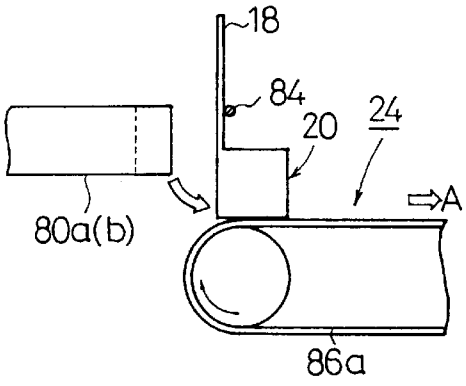
FIG. 9B is a fragmentary side elevational view showing the packaging carton immediately after it is delivered from the packaging device to the packaging carton conveying device.
Figure 9C:
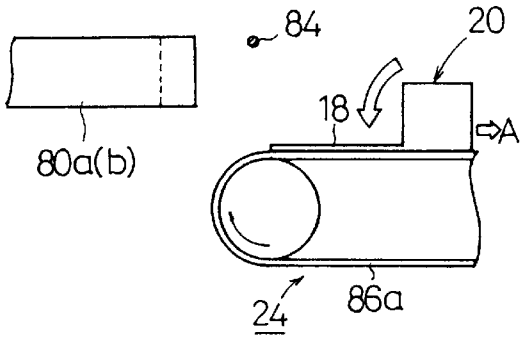
FIG. 9C is a fragmentary side elevational view showing the packaging carton when it is conveyed by the packaging carton conveying device.

Subsequently, as shown in FIGS. 9A and 9B, each of the first packaging cartons 20 is engaged by the rod 84 and turned 90° thereby, and then transferred from the belts 80*a*, 80*b* onto the conveyor 86*a*. As the first packaging carton 20 is moved by the conveyor 86*a*, the hanger 18 thereof is pushed downwardly by the rod 84, further turning the first packaging carton 20 by 90° as shown in FIG. 9C. As a result, the first packaging carton 20 is inverted 180° with the hangers 18 positioned downwardly and directed upstream in the direction indicated by the arrow A.

The first packaging cartons 20 are then delivered successively by the conveyors 86*a*, 86*b*, 86*c*, 86*d*. The weight checker associated with the conveyor 86*a* checks if the weight of the contents of each first packaging carton 20 is normal or not. If not normal, then the checked first packaging carton 20 is rejected. Only those first packaging cartons 20 which carry a normal weight are successively delivered to the conveyor 92 of the charging device 28. As described later on, when a predetermined number of first packaging cartons 20 are picked up from the conveyor 92 by the first and second packaging carton pickup means 116, 118, it is necessary to prevent the first packaging cartons 20 stopped on the conveyor 92 from being subjected to an undue load. To meet such a requirement, the seventh photosensor 88 detects a first packaging carton 20 on the conveyor 86*b* and produces a signal to control the conveyors 86*a*~86*d* to operate intermittently.

The first packaging cartons 20 introduced into the charging device 28 are detected by the eighth photosensor 94, and successively fed by the conveyor 92 in the direction indicated by the arrow B in FIG. 5 until the foremost first packaging carton 20 abuts against the stopper 112 which is located in the two-dot-and-dash lines in FIG. 5. When eight first packaging cartons 20 are arrayed in a row between the stopper 112 and the packaging carton checking means 96, the cylinder 100 of the packaging carton checking means 96 is operated thereby to swing the movable pad 104 toward the fixed pad 98, holding ninth and following first packaging cartons 20. Then, the cylinder 108 of the packaging carton end limiting means 106 is operated to move the rod 110 and hence the stopper 112 in the direction indicated by the arrow B. The eight first packaging cartons 20 between the stopper 112 and the packaging carton checking means 96 are now displaced by the conveyor 92 in the direction indicated by the arrow B until they reach the packaging carton pickup position P1 (see FIG. 6).

Figure 10:
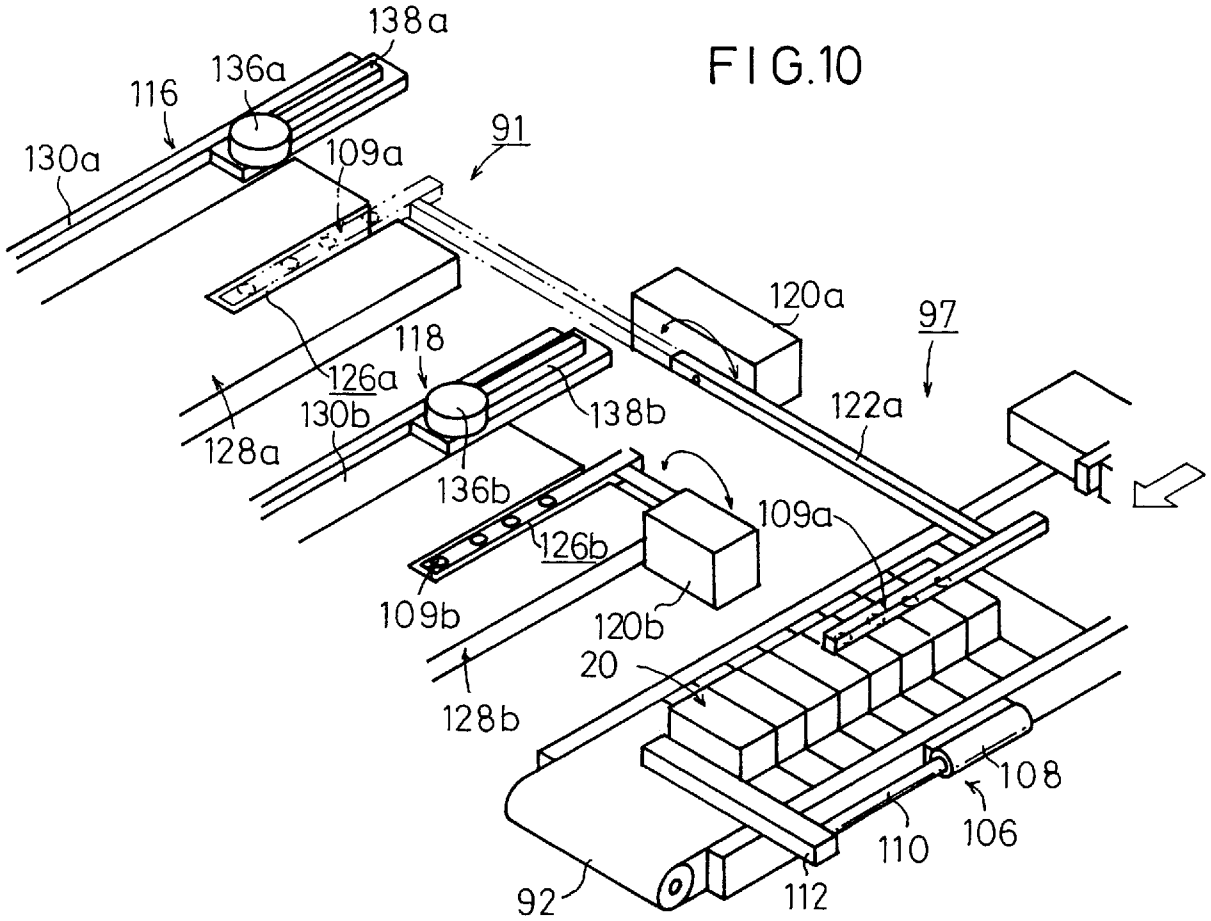
FIG. 10 is a fragmentary perspective view showing the manner in which a distribution mechanism of the charging device operates.

Thereafter, as shown in FIG. 10, the first rotary actuator 120*a* of the first packaging carton pickup means 116 is operated to turn the first rotary arm 122*a* toward the conveyor 92. The first through fourth suction pads 124*a*~124*d* on the tip end of the first rotary arm 122*a* are brought into abutment against 5th~8th first packaging cartons 20 of the eight first packaging cartons 20 which are held on the conveyor 92 by the stopper 112. The first through fourth suction pads 124*a*~124*d* then attracts these 5th~8th first packaging cartons 20 under suction when the vacuum pump 125 is operated.

Then, the first rotary actuator 120*a* is operated again to cause the first rotary arm 122*a* to turn the first through fourth suction pads 124*a*~124*d* which have attracted the respective first packaging cartons 20 through 180° from the conveyor 92 toward the first guide plate 128*a*. When the first through fourth suction pads 124*a*~124*d* reach the first guide plate 128*a*, they enter the first groove 126*a* defined in the first guide plate 128*a*, placing the four first packaging cartons 20 on the upper surface of the first guide plate 128*a* as indicated by the solid lines in FIG. 8.

Figure 11:
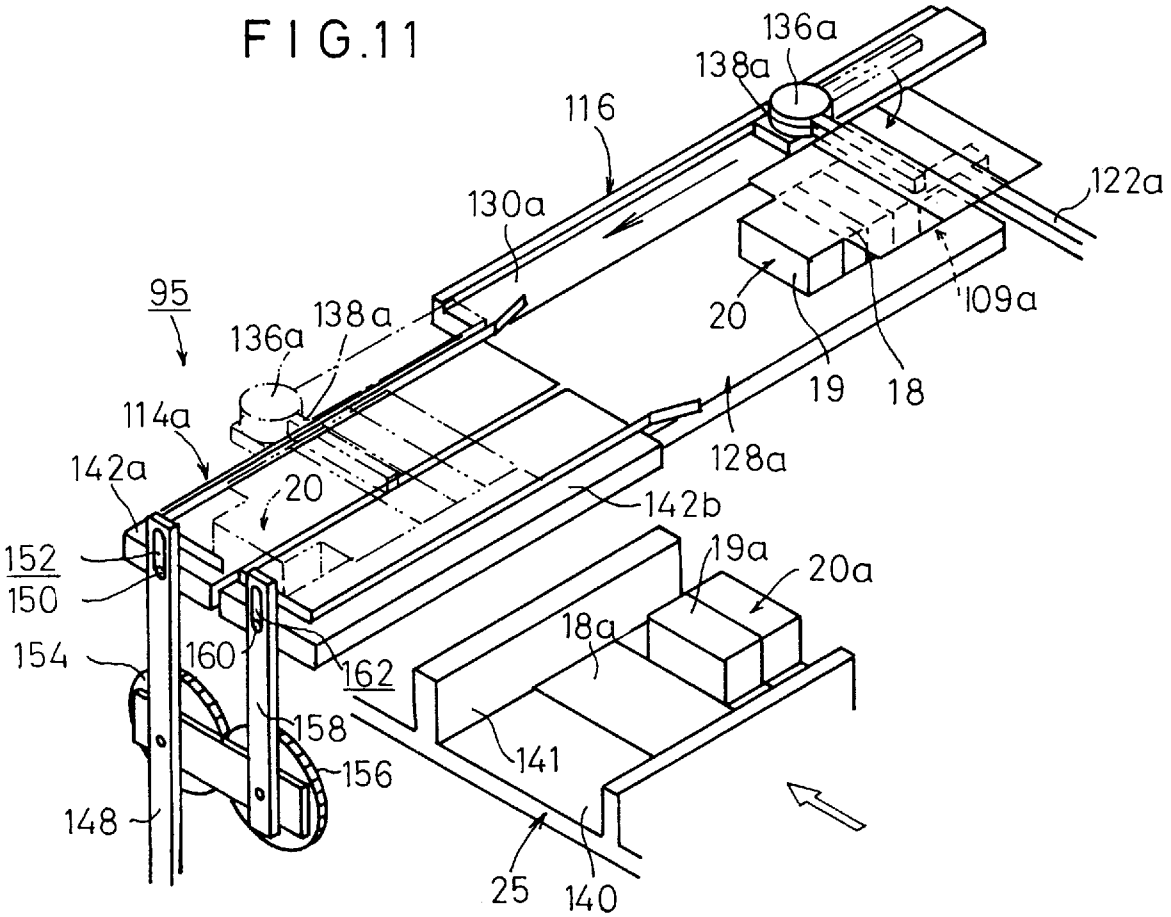
FIG. 11 is a fragmentary perspective view showing the manner in which a packaging carton pickup mechanism of the charging device operates.

After the vacuum pump 125 is inactivated to release the first packaging cartons 20 from the first through fourth suction pads 124*a*~124*d*, as shown in FIG. 5, the first rotary actuator 136*a* is operated to turn the first pusher rod 128*a* toward the first guide plate 128*a*, and the first rodless cylinder 132*a* is actuated to move the first pusher rod 128*a* toward the first arraying station 114*a* in the direction indicated by the arrow B until the four first packaging cartons 20 are placed on the support plates 142*a*, 142*b* as indicated by the two-dot-and-dash lines in FIG. 11.

After the four first packaging cartons 20 have been delivered from the conveyor 92 to the first guide plate 128*a* by the first suction means 109*a*, the second suction means 109*b* is operated. The remaining four first packaging cartons 20 which are positioned on the conveyor 92 by the stopper 112 are carried onto the second guide plate 128*b* of the second packaging carton pickup means 118 by the second suction means 109*b*, and thereafter delivered to the second arraying station 114*b*.

As shown in FIGS. 4 through 6, second packaging cartons 20*a* which are fed by the packaging carton conveying mechanism 25 are introduced into the buckets 141 of the packaging carton conveyor 140 by the robot 172. At this time, two second packaging cartons 20*a* are placed into each of the buckets 141. The packaging carton conveyor 140 moves in the direction indicated by the arrow C to deliver the second packaging cartons 20*a* in the buckets 141 into the first and second arraying stations 114*a*, 114*b*.

Figure 12:
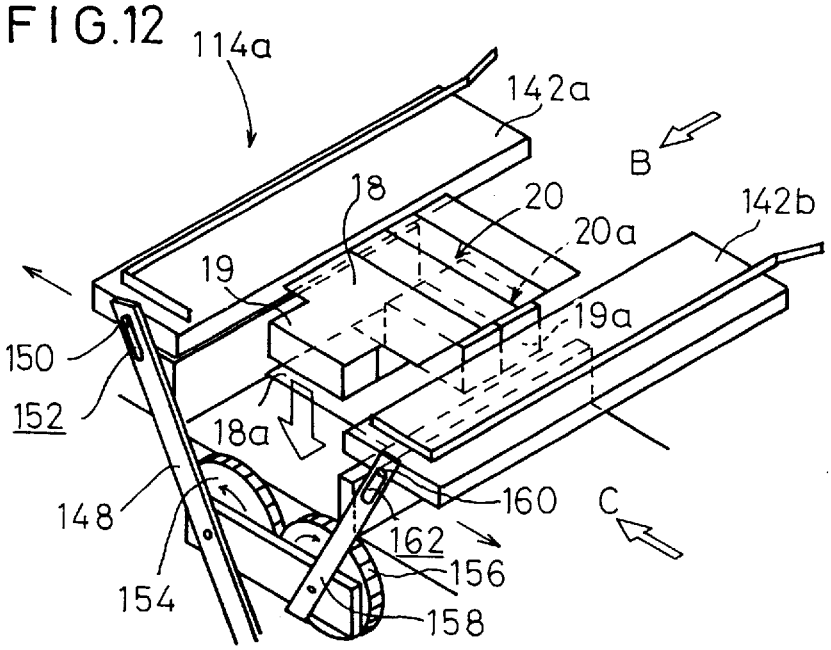
FIG. 12 is a fragmentary perspective view showing the manner in which a packaging carton placing mechanism of the charging device operates.

The cylinders 144 in the respective first and second arraying stations 114*a*, 114*b* are operated to retract their rods 146 for thereby turning the longer links 148 in the direction indicated by the arrow D in FIGS. 6 and 7. Therefore, the first gears 154 fixed to the longer links 148 are rotated, causing the second gears 156 meshing therewith to turn the shorter links 158 in the direction indicated by the arrow E. The support plates 142*a*, 142*b* whose pins 150, 160 are received in the respective oblong holes 152, 162 defined in the upper ends of the longer and shorter links 148, 158 are horizontally displaced away from each other, dropping the respective sets of four first packaging cartons 20 onto the packaging carton conveyor 140 as shown in FIG. 12.

Each of the first packaging cartons 20 on the support plates 142*a*, 142*b* has been inverted in attitude from its attitude on the conveyor 92, with the hanger 18 positioned upwardly and rearward (upstream of the packaging carton housing 19) in the direction indicated by the arrow B. Each of the second packaging cartons 20*a* on the packaging carton conveyor 140 has its hanger 18*a* positioned downwardly and forward (downstream of the packaging carton housing 19*a*) in the direction indicated by the arrow B. Therefore, the four first packaging cartons 20 and the two second packaging cartons 20*a* with their hangers 18, 18*a* oriented in opposite direction are now arrayed in each of the buckets 141 in the first and second arraying stations 114*a*, 114*b*.

When the second packaging cartons 20*a* are introduced into the buckets 141 on the packaging carton conveyor 140, only the first suction means 109*a* is operated. Specifically, after eight first packaging cartons 20 are positioned on the conveyor 92 by the stopper 112, 5th~8th first packaging cartons 20 of the eight first packaging cartons 20 are picked up by the first packaging carton pickup means 116 and carried onto to the first guide plate 128*a*.

Then, the cylinder 108 is operated to return the stopper 112 from the solid-line position to the two-dot-and-dash-line position in FIG. 5. The air nozzles 113*a*, 113*b* eject air to the hanger 18 of the fourth one of the four first packaging cartons 20 which are held by the stopper 112. Then, the cylinder 100 of the packaging carton checking means 96 is operated to move the movable pad 104 away from the first packaging cartons 20, and next four first packaging cartons 20 are delivered toward the four first packaging cartons 20 held by the stopper 112 in alignment therewith.

Since the hanger 18 of the fourth first packaging carton 20 held by the stopper 112 is pressed against the conveyor 92 by the pressure of the air ejected by the air nozzles 113*a*, 113*b*, the pressed hanger 18 is prevented from being lifted into interference with the next four first packaging cartons 20 which are newly delivered toward these four first packaging cartons 20 held by the stopper 112.

The cylinder 108 is operated again to move the stopper 112 to the solid-line position for thereby positioning eight first packaging cartons 20 against the stopper 112. Subsequent first packaging cartons 20 are kept by the packaging carton checking means 96 from moving toward the eight first packaging cartons 20 held by the stopper 112.

After the four first packaging cartons 20 and the two second packaging cartons 20*a* have been arrayed in each of the buckets 141 in the first and second arraying stations 114*a*, 114*b*, these first and second packaging cartons 20, 20*a* are delivered to the packaging carton inserting station 178 (see FIG. 1). In the packaging carton inserting station 178, a formed box 26 is fed along the box feed path 180, and a predetermined number of first and second packaging cartons 20, 20*a* are inserted into the box 26 by pushers (not shown). Thereafter, the flaps of the box 26 are bonded by the hot-melt mechanism, and the box 26 is printed by the printer.

According to the illustrated embodiment, as shown in FIG. 2, the entire process of inserting tubular casings 14 each housing a roll 12 of unexposed photographic film into respective first packaging cartons 20, arraying predetermined numbers of first and second packaging cartons 20, 20*a* which are oriented in opposite directions, and inserting the first and second packaging cartons 20, 20*a* into a box 26 is automatically carried out. Therefore, the film packaging process according to the present invention is effected more efficiently than the conventional manual film packaging process.

Furthermore, the tubular casing arraying and conveying device 16 for arraying and conveying tubular casings 14, the packing device 22 for inserting the tubular casings 14 into respective first packaging cartons 20, the packaging carton conveying device 24 for successively conveying the first packaging cartons 20 with the respective tubular casings 14 housed therein, and the charging device 28 for arraying four first packaging cartons 20 and two second packaging cartons 20*a* with respective hangers 18, 18*a* oriented in opposite directions and inserting the array of first and second packaging cartons 20, 20*a* into a box 26, are individually controlled by the first through fourth controllers 30, 32, 34, 36.

Since the tubular casing arraying and conveying device 16, the packing device 22, the packaging carton conveying device 24, and the charging device 28 can individually be operated under the control of the first through fourth controllers 30, 32, 34, 36, it is possible to modify easily the film packaging process carried out by the film packaging system 10 when the film packaging system 10 undergoes various changes to specifications. Consequently, the film packaging process and the film packaging system 10 are highly versatile and efficient regardless of such changes to specifications.

In the illustrated embodiment, while a desired number of first packaging cartons 20 placed in the packaging carton pickup position P1 are being inverted and carried toward the packaging carton placing mechanism 95 by the packaging carton pickup mechanism 91, a desired number of second packaging cartons 20*a* are delivered to the arraying positions P2 below the packaging carton placing mechanism 95 by the packaging carton conveying mechanism 25. Thereafter, the packaging carton placing mechanism 95 is opened to supply the first packaging cartons 20 to the second packaging cartons 20*a*, making up an array of first and second packaging cartons 20, 20*a*.

At this time, each of the second packaging cartons 20*a* has its hanger 18*a* positioned downwardly, and each of the first packaging cartons 20 has its hanger 18 positioned upwardly and directed toward the packaging carton housing 19*a* of the second packaging carton 20*a*. When the packaging carton placing mechanism 95 is opened, the first and second packaging cartons 20, 20*a* are arrayed such that the hangers 18, 18*a* and the packaging carton housings 19, 19*a* are superimposed on each other. It is thus possible to array respective numbers of first and second packaging cartons 20, 20*a* automatically and efficiently.

The distribution mechanism 97 is provided for placing a desired number of first packaging cartons 20 in the packaging carton pickup position P1. Specifically, the distribution mechanism 97 permits an arbitrary number of successive first packaging cartons 20 to be delivered into the packaging carton pickup position P1. It is thus possible to vary the numbers of first and second packaging cartons 20, 20*a* which are combined with each other in the first and second arraying stations 114*a*, 114*b*.

Figure 13:
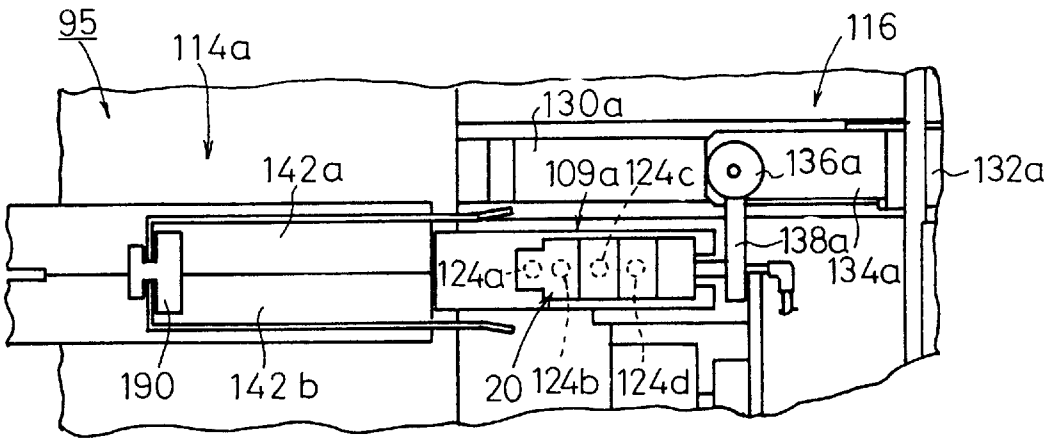
FIG. 13 is a fragmentary plan view of the packaging carton placing mechanism with a stopper mounted thereon.

To vary the numbers of first and second packaging cartons 20, 20*a* which are combined with each other, the positions of the distribution mechanism 97 and the packaging carton end limiting means 106 are changed depending on the number of first packaging cartons 20, and, as shown in FIG. 13, each of the first and second arraying stations 114*a*, 114*b* has a removable stopper 190 whose dimensions correspond to the dimensions of the first packaging cartons 20 to adjust the number of first packaging cartons 20 on the support plates 142*a*, 142*b*.

In the illustrated embodiment, furthermore, groups of the first packaging cartons 20 placed in the packaging carton pickup position P1 are alternately picked up by the first and second suction means 109*a*, 109*b*, and then delivered respectively into the first and second arraying stations 114*a*, 114*b*. This is effective to make the packaging carton arraying process highly efficient.

Although a certain preferred embodiment of the present invention has been shown and described in detail, it should be understood that various changes and modifications may be made therein without departing from the scope of the appended claims.

What is claimed is:

1. A system for packaging rolls of photographic film, comprising:

a tubular casing arraying and conveying device for arraying and conveying tubular casings each housing a roll of unexposed photographic film;

a packing device for inserting the tubular casings into respective first packaging cartons each having a packaging carton housing and a tongue-like hanger integral with the packaging carton housing;

a packaging carton conveying device for successively conveying the first packaging cartons with the tubular casings inserted therein, comprising attitude changing means for changing the attitude of said first packaging cartons, wherein said attitude changing means comprises:

a pair of belts for gripping therebetween opposite sides of said first packaging cartons; and a rod disposed downstream of said belts for engaging the hanger of each of said first packaging cartons to invert the first packaging carton through approximately 180° in a direction in which said first packaging cartons are conveyed; and a charging device for picking up a predetermined number of first packaging cartons conveyed by said packaging carton conveying device, arraying the said predetermined number of first packaging cartons and a predetermined number of second packaging cartons, each having a packaging carton housing and a tongue-like hanger integral with the packaging carton housing, such that the hangers and the packaging carton housings are superimposed of each other, and placing the array of first and second packaging cartons into a box.

2. A system according to claim 1, further comprising:

a first controller for individually controlling said tubular casing arraying and conveying device;

a second controller for individually controlling said packing device;

a third controller for individually controlling said packaging carton conveying device;

a fourth controller for individually controlling said charging device; and a main controller for controlling said first controller, said second controller, said third controller, and said fourth controller.

3. A system according to claim 1, wherein said tubular casing arraying and conveying device comprises:

a hopper for discharging the tubular casings;

a first lift conveyor for delivering the tubular casings from said hopper;

a second lift conveyor for delivering upwardly the tubular casings delivered from said first lift conveyor and arranging said tubular casings into an array; and a chute for delivering the array of tubular casings from said second lift conveyor with a predetermined orientation to said packing device.

4. A system according to claim 3, wherein said second lift conveyor has a rubber member disposed in a tubular casing passage thereof for preventing the tubular casings from being superimposed and hence damaged.

5. A system according to claim 1, wherein said charging device comprises:

a packaging carton pickup mechanism for picking up said predetermined number of first packaging cartons from a packaging carton pickup position;

a packaging carton conveying mechanism for placing said predetermined number of second packaging cartons with the hangers thereof positioned downwardly such that said hangers are positioned as a bottom surface of said packaging cartons, parallel to said packaging carton conveying mechanism, and conveying the second packaging cartons to an arraying position; and a packaging carton placing mechanism for placing said predetermined number of first packaging cartons picked up by said packaging carton pickup mechanism such that the hangers thereof are positioned upwardly such that said hangers are positioned as a top surface of said packaging cartons, parallel to said packaging carton placing mechanism, and directed toward the packaging carton housings of said second packaging cartons, said packaging carton placing mechanism being selectively openable and closable above said packaging carton conveying mechanism in said arraying position.

6. A system according to claim 5, wherein said packaging carton pickup mechanism comprises:

a pair of suction means for attracting under suction respective numbers of first packaging cartons from said predetermined number of first packaging cartons in said packaging carton pickup position;

a pair of inverting means for inverting said suction means, respectively, with the respective numbers of first packaging cartons attracted thereto; and a pair of packaging carton pickup means for delivering the respective numbers of first packaging cartons inverted by said inverting means to said packaging carton placing mechanism.

7. A system according to claim 5, wherein said suction means comprise suction means for alternately picking up the respective numbers of first packaging cartons from said predetermined number of first packaging cartons in said packaging carton pickup position, and said packaging carton placing mechanism comprises first and second placing areas for placing the respective numbers of first packaging cartons picked up respectively by said suction means.

8. A system according to claim 1, further comprising a distribution mechanism for placing a predetermined number of first packaging cartons in a packaging carton pickup position, said distribution mechanism comprising:

a conveyor for delivering first packaging cartons to a packaging carton pickup position;

packaging carton checking means for engaging a first packaging carton on said conveyor; and packaging carton end limiting means engageable with an end of the first packaging carton of said conveyor and movable back and forth between a first stop position and a second stop position, for feeding a predetermined number of first packaging cartons downstream of said packaging carton checking means when in said first stop position, and positioning a predetermined number of first packaging cartons in said packaging carton pickup position when in said second stop position.

9. A system for packaging rolls of photographic film, comprising:

a packaging carton pickup mechanism for picking up said predetermined number of first packaging cartons from a packaging carton pickup position, each of said first packaging cartons housing a tubular casing with a roll of unexposed photographic film therein and having a packaging carton housing and a tongue-like hanger integral with the packaging carton housing;

a packaging carton conveying mechanism for placing a predetermined number of second packaging cartons each having a packaging carton housing an a tongue-like hanger integral with the packaging carton housing, with the hangers thereof positioned downwardly such that said hangers are positioned as a bottom surface of said packaging cartons, parallel to said packaging carton conveying mechanism, and conveying the second packaging cartons to an arraying position; and a packaging carton placing mechanism for placing said predetermined number of first packaging cartons picked up by said packaging carton pickup mechanism such that the hangers thereof are positioned upwardly such that said hangers are positioned as a top surface of said packaging carton, parallel to said packaging carton placing mechanism, and directed toward the packaging carton housings of said second packaging cartons, said packaging carton placing mechanism being selectively openable and closable above said packaging carton conveying mechanism in said arraying position.

10. A system according to claim 9, wherein said packaging carton pickup mechanism comprises:

a pair of suction means for attracting under suction respective numbers of first packaging cartons from said predetermined number of first packaging cartons in said packaging carton pickup position;

a pair of inverting means for inverting said suction means, respectively, with the respective numbers of first packaging cartons attracted thereto; and a pair of packaging carton pickup means for delivering the respective numbers of first packaging cartons inverted by said inverting means to said packaging carton placing mechanism.

11. A system according to claim 10, wherein said suction means comprise suction means for alternately picking up the respective numbers of first packaging cartons from said predetermined number of first packaging cartons in said packaging carton pickup position, and said packaging carton placing mechanism comprises first and second placing areas for placing the respective numbers of first packaging cartons picked up respectively by said suction means.

12. A system according to claim 9, further comprising a distribution mechanism for placing a predetermined number of first packaging cartons in a packaging carton pickup position, said distribution mechanism comprising:

a conveyor for delivering first packaging cartons to a packaging carton pickup position;

packaging carton checking means for engaging a first packaging carton on said conveyor; and packaging carton end limiting means engageable with an end of the first packaging carton on said conveyor and movable back and forth between a first stop position and a second stop position, for feeding a predetermined number of first packaging cartons downstream of said packaging carton checking means when in said first stop position, and positioning a predetermined number of first packaging cartons in said packaging carton pickup position when in said second stop position.

13. A system according to claim 9, wherein said packaging carton placing mechanism comprises a removable stopper having dimensions corresponding to dimensions of the first packaging cartons to adjust the number of first packaging cartons above said arraying position.

14. A system for packaging rolls of photographic film, comprising:

a tubular casing arraying and conveying device for arraying and conveying tubular casings each housing a roll of unexposed photographic film;

a packing device for inserting the tubular casings into respective first packaging cartons each having a packaging carton housing and a tongue-like hanger integral with the packaging carton housing;

a packaging carton conveying device for successively conveying the first packaging cartons with the tubular casings inserted therein;

a packaging carton pickup mechanism for picking up said predetermined number of first packaging cartons from a packaging carton pickup position;

a packaging carton conveying mechanism for placing said predetermined number of second packaging cartons with the hangers thereof positioned downwardly such that said hangers are positioned as a bottom surface of said packaging cartons, parallel to said packaging carton conveying mechanism, and conveying the second packaging cartons to an arraying position; and a packaging carton placing mechanism for placing said predetermined number of first packaging cartons picked up by said packaging carton pickup mechanism such that the hangers thereof are positioned upwardly such that said hangers are positioned as a top surface of said packaging cartons, parallel to said packaging carton placing mechanism, and directed toward the packaging carton housings of said second packaging cartons, said packaging carton placing mechanism being selectively openable and closable above said packaging carton conveying mechanism in said arraying position; and a charging device for picking up a predetermined number of first packaging cartons conveyed by said packaging carton conveying device, arraying the said predetermined number of first packaging cartons and a predetermined number of second packaging cartons, each having a packaging carton housing and a tongue-like hanger integral with the packaging carton housing, such that the hangers and the packaging carton housings are superimposed of each other, and placing the array of first and second packaging cartons into a box.

15. A system according to claim 14, wherein said packaging carton pickup mechanism comprises:

a pair of suction means for attracting under suction respective numbers of first packaging cartons from said predetermined number of first packaging cartons in said packaging cartons pickup position;

a pair of inverting means for inverting said suction means, respectively, with the respective numbers of first packaging cartons attracted thereto; and a pair of packaging carton pickup means for delivering the respective numbers of first packaging cartons inverted by said inverting means to said packaging carton placing mechanism.

16. A system according to claim 14, wherein said suction means comprise suction means for alternately picking up the respective numbers of first packaging cartons from said predetermined number of first packaging cartons in said packaging carton pickup position, and said packaging carton placing mechanism comprises first and second placing areas for placing the respective numbers of first packaging cartons picked up respectively by said suction means.

* * * * *